US011253969B2

(12) United States Patent
Ho

(10) Patent No.: US 11,253,969 B2
(45) Date of Patent: Feb. 22, 2022

(54) BELT SANDER HAVING FAST-LIFT COVER STRUCTURE

(71) Applicant: BASSO INDUSTRY CORP., Taichung (TW)

(72) Inventor: Ching-Chih Ho, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 600 days.

(21) Appl. No.: 15/997,486

(22) Filed: Jun. 4, 2018

(65) Prior Publication Data

US 2018/0345443 A1 Dec. 6, 2018

(30) Foreign Application Priority Data

Jun. 5, 2017 (TW) ..... 106118527

(51) Int. Cl.
*B24B 23/06* (2006.01)

(52) U.S. Cl.
CPC ..... *B24B 23/06* (2013.01)

(58) Field of Classification Search
CPC ..... B24B 23/00; B24B 23/06; B24B 55/04; B24B 55/057; B24B 55/08; B24B 55/10; B24B 55/107; B27G 19/003; B27G 19/06; B27G 19/00–10; Y10T 403/595; Y10T 403/602; F16B 2/18; F16B 2/185
USPC ..... 451/355, 451, 454
See application file for complete search history.

(56) References Cited

U.S. PATENT DOCUMENTS 4,368,597 A * 1/1983 Fleckenstein ..... B24B 23/06 451/311
9,511,468 B2 * 12/2016 Suzuki ..... B24B 23/06

FOREIGN PATENT DOCUMENTS

JP 3010197 B1 2/2000

OTHER PUBLICATIONS

Office Action dated Nov. 20, 2020 of the corresponding Taiwan patent application No. 106118527.

* cited by examiner

*Primary Examiner* — Orlando E Aviles
*Assistant Examiner* — Robert F Neibaur
(74) *Attorney, Agent, or Firm* — Chun-Ming Shih; HDLS IPR Services

(57) ABSTRACT

A belt sander having a fast-lift cover structure includes a drive mechanism, a body and a cover. The drive mechanism includes a drive module, a tension arm, a sanding belt surrounding the drive module and the tension arm. The body receives the drive module. The body includes a base, an extendable support rod extended from the body and connected to the tension arm, and a cover fastening assembly disposed at the base. The cover fastening assembly includes a release and a resilient element for restoring the release to its original position. One end of a cover is pivotally connected at one side of the body, and the other end of the cover includes a fastening portion engaged with the release. Operation is easy, no hand tools are required, and the cover does not fall off.

8 Claims, 12 Drawing Sheets

BELT SANDER HAVING FAST-LIFT COVER STRUCTURE

TECHNICAL FIELD

The present invention relates to a belt sander and, in particular, to a belt sander having a fast-lift cover structure, which allows removal or replacement of components to be achieved without any hand tool.

BACKGROUND

An air belt sander performs a sanding operation by using sandpapers with different grit sizes to rub on surfaces of metal, wood, plastic, rock, glass and pottery. The air belt sander has advantages such as small size, low noises, efficient sanding, and small vibrations. The air belt sander is widely used in various fields, such as machinery, construction, furniture, painting, shipbuilding, cars, and airplanes, for polishing, removing burrs, removing rust, finishing painting, and etc.

A cover fixed at one side of an air motor needs to be detached if maintenance work or component replacement has to be carried out when an annular sanding belt is worn out, or impurities such as dust get into an air motor, or a drive shaft is rusted, or for other reasons. There are several ways to fasten the cover. One way is to fasten the cover with screws, but the cover is often detached from a body, resulting in troubles in management and use. A second way is to fasten the cover to the body by using a pin. This prevents detachment of the cover, but the pin has to be operated manually, and since the pin is exposed from the body, the cover can be opened accidently due to an inadvertent touch. A third way is to fasten one end of the cover to the body by means of screws and use the fixed end as a rotation axis. Before rotating the cover, an operator has to loosen screws at the other end of the cover to open the cover. However, the screws are often too tight, so the operator has to use hand tools to unfasten them, which makes detachment of the cover troublesome and time-consuming.

In view of this, the inventor studied various technologies and created an effective solution in the present disclosure.

SUMMARY

It is an objective for the present invention to provide a belt sander having a fast-lift cover structure, which allows easy operations without hand tools and prevents a cover from falling off.

Accordingly, a belt sander having a fast-lift cover structure is provided. The belt sander comprises a drive mechanism, a body and a cover. The drive mechanism includes a drive module, a tension arm, and a sanding belt surrounding the drive module and the tension arm. The body receives the drive module. The body includes a base, an extendable support rod extended from the body and connected to the tension arm, and a cover fastening assembly at the base. The cover fastening assembly includes a release and a resilient element for restoring the release to its original position. One end of the cover is pivotally connected at one side of the body, and the other end of the cover includes a fastening portion engaged with the release. The tension arm includes a contact portion, and the contact portion is disposed corresponding to release for pushing the same.

By pressing the tension arm of the belt sander, the cover can be opened fast and automatically. No hand tools are required during the process of opening the cover. Opening operation is easy and does not cause the cover to be detached and fall off from the body. Furthermore, the cover fastening assembly is disposed inside the body, and the fastening portion of the cover is engaged inside the body with the cover fastening assembly, so an operator is prevented from inadvertently touching the cover to open it, thereby preventing danger. In other words, the belt sander greatly improves safety in use.

In one embodiment of the present invention, when the cover is unlocked, the cover automatically bounces open. As a result, maintenance or replacement of the components is easy and time efficient. When the cover and the cover fastening assembly is back to a locked state, the fastening portion is resiliently engaged with the hook again, so opening or closing operation is easy and simple.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
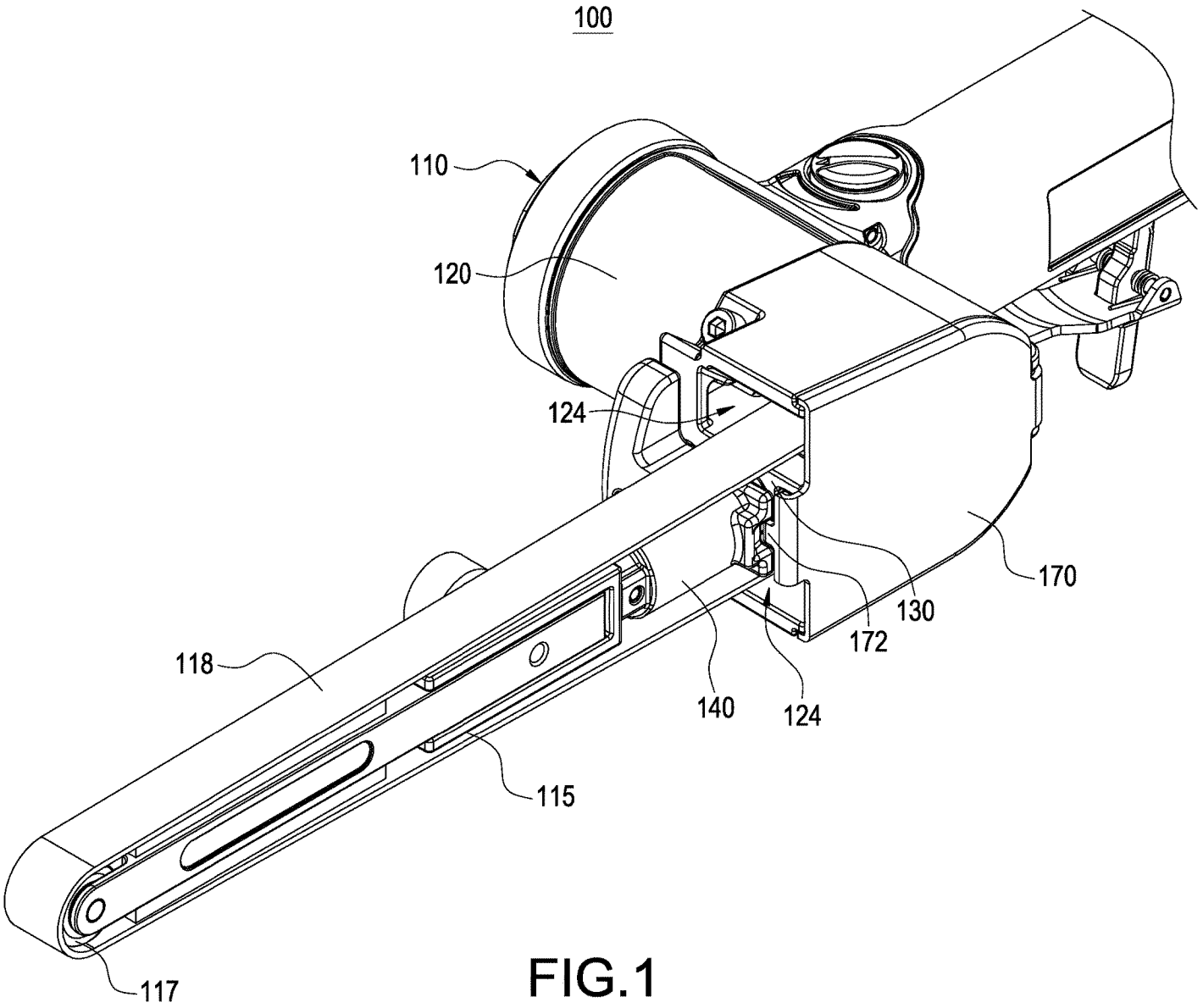
FIG. 1 is a perspective partial view according to the first embodiment of the present invention.
Figure 2:
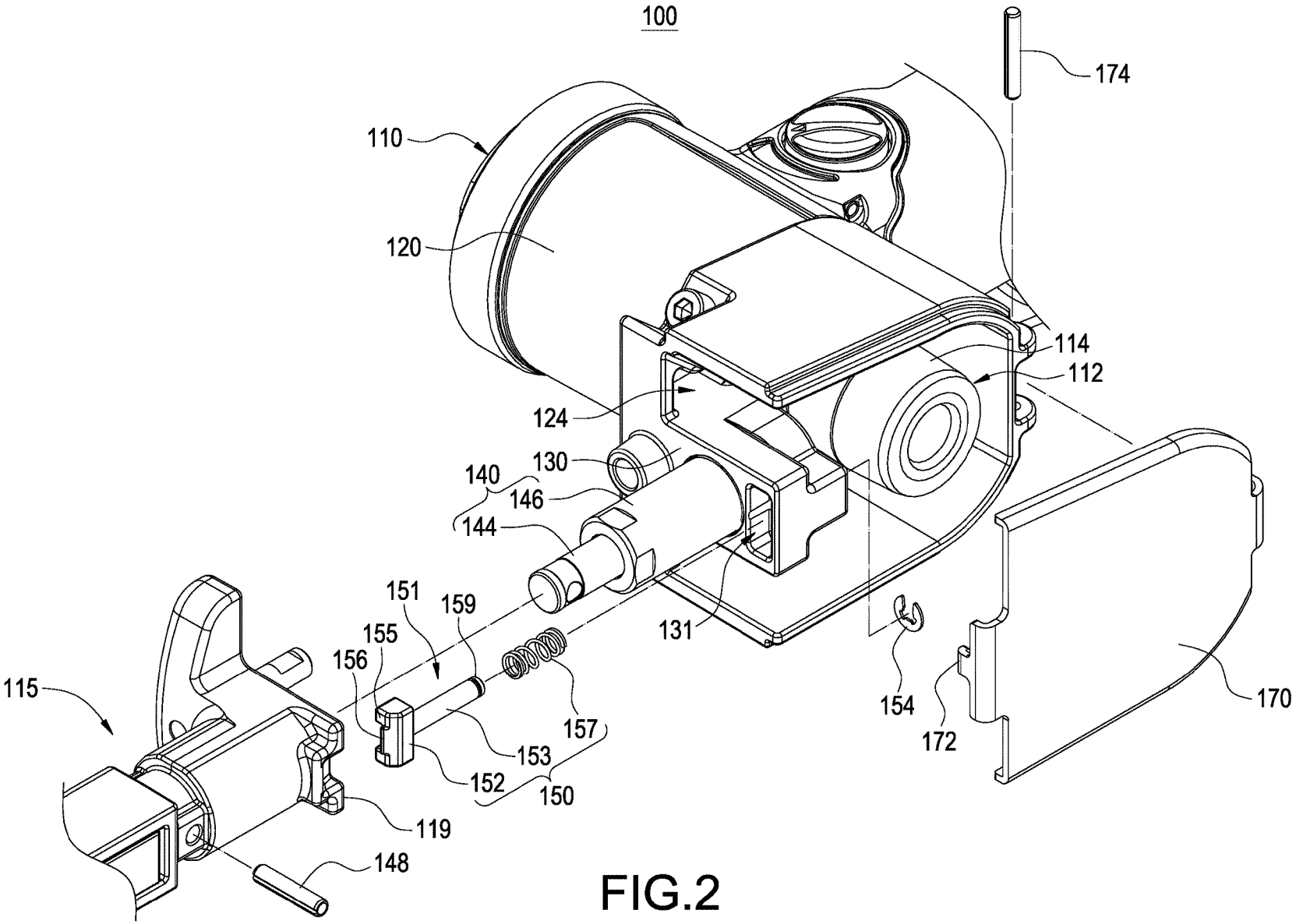
FIG. 2 is a partial exploded view according to the first embodiment of the present invention.

Detailed descriptions and technical contents of the present disclosure are illustrated below in conjunction with the accompanying drawings. However, it is to be understood that the descriptions and the accompanying drawings disclosed herein are merely illustrative and exemplary and not intended to limit the scope of the present disclosure.

Please refer to FIGS. 1 to 4 for drawings in connection with the first embodiment of the present invention. The present invention provides a belt sander 100 having a fast-lift cover structure. The belt sander 100 includes but, is not limited to, an electric belt sander, an air belt sander, a belt grinding machine, or a belt grinder.

As shown in the drawings, the belt sander 100 includes a drive mechanism 110, a body 120 and a cover 170. The drive mechanism 110 includes a drive module 112, a tension arm 115, and a sanding belt 118 surrounding the drive module 112 and the tension arm 115. The body 120 is made of iron, an alloy thereof, or other suitable rigid material. An accommodating space 122 is formed inside the body 120 for receiving the drive module 112. The body 120 includes a base 130, an extendable support rod 140 extended from one side of the body 120 and connected to the tension arm 115, and a cover fastening assembly 150 at the base 130.

In the first embodiment, the drive module 112 consists of, for example, an air motor 113 and a drive wheel 114 connected to the air motor 113. The tension arm 115. A driven wheel 117 is pivotally connected to a front end of the tension arm 115 and is disposed opposite to the driven wheel 114. Two insertion holes 124 for insertion of the sanding belt 118 are formed at two sides of the base 130. The insertion hole 124 communicates with the accommodating space 122. The sanding belt 118 surrounds the drive wheel 114 and the driven wheel 117 and is inserted through the two insertion holes 124. The air motor 113 drives the drive wheel 114 to rotate the sanding belt 118 for sanding operations.

Figure 3:
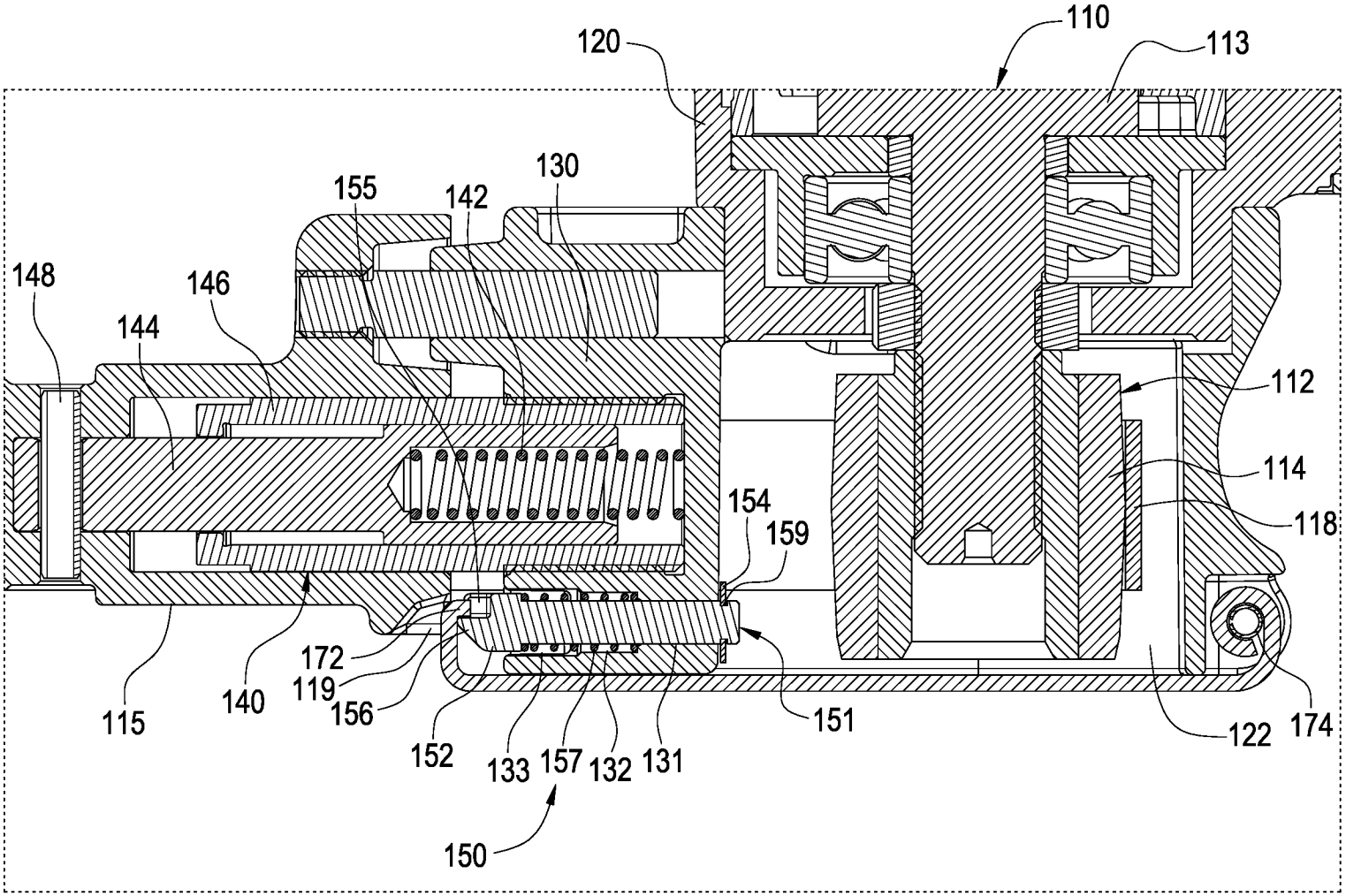
FIG. 3 is a partial cross-sectional view according to the first embodiment of the present invention.
Figure 4:
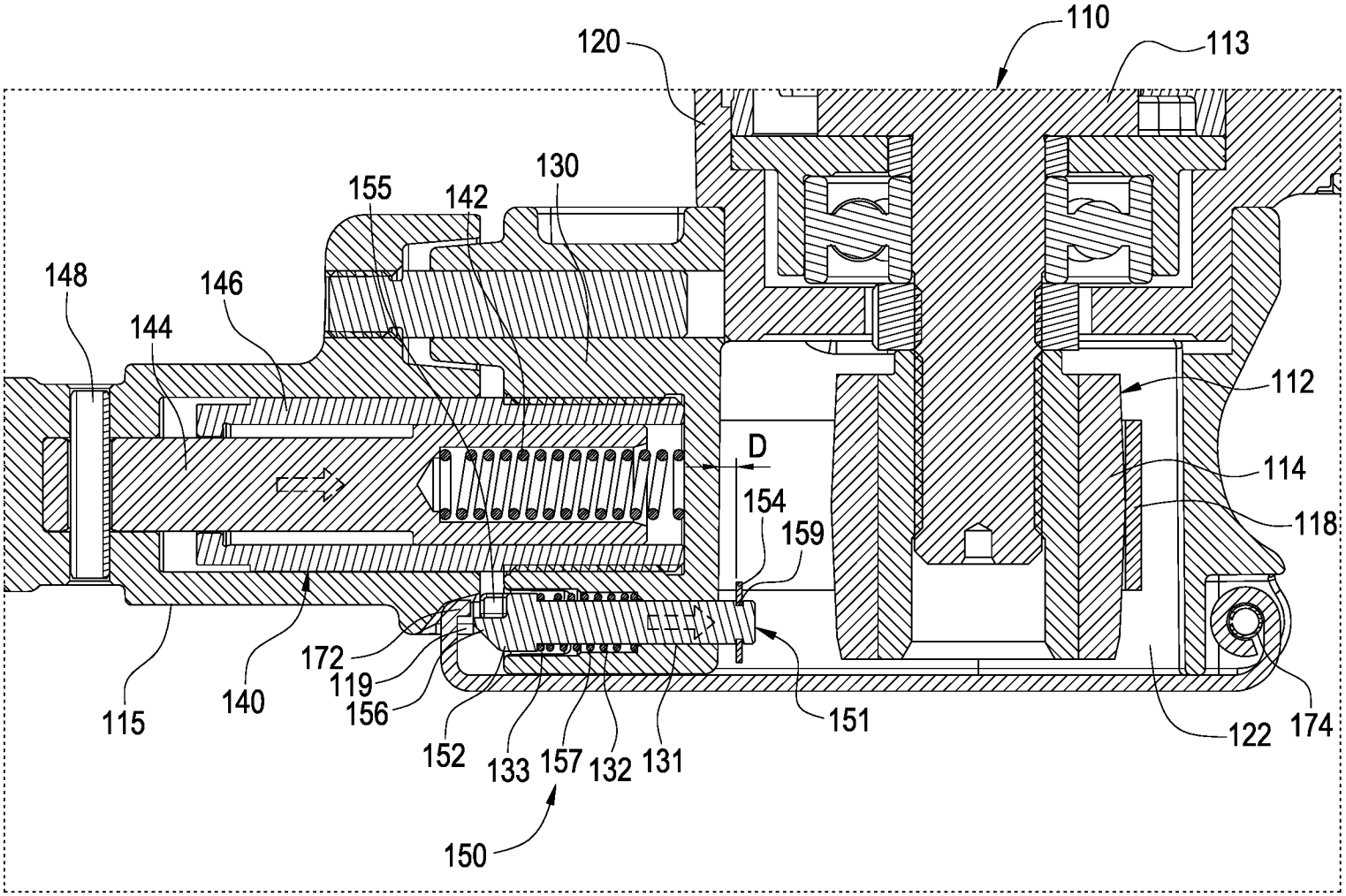
FIG. 4 is another partial cross-sectional view according to the first embodiment of the present invention.
Figure 5:
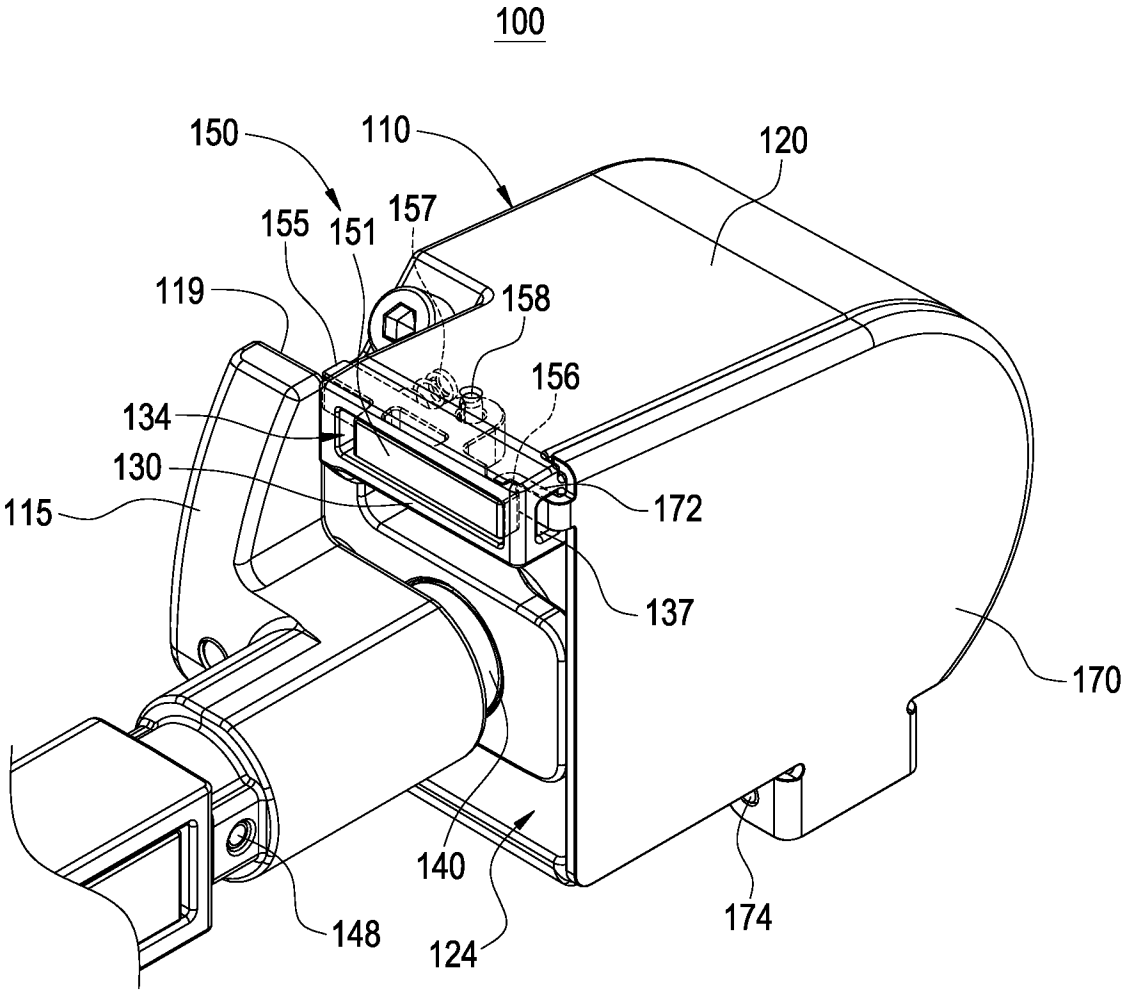
FIG. 5 is a partial perspective view according to the second embodiment of the present invention.

Referring to FIGS. 3 and 4, the extendable support rod 140 includes a spring 142, a positioning rod 144 receiving the spring 142, and a sleeve 146 receiving the positioning rod 144. The spring 142 is, for example, a compression spring or other suitable spring. A positioning pin 148 is inserted through the tension arm 115 and the positioning rod 144, so that the positioning rod 144 and the tension arm 115 are fixed to each other and can move together. The tension arm 115 is preferably mounted on the extendable support rod 140 and is restored to its original position by means of the spring 142. The tension arm 115 includes a contact portion 119, the contact portion 119 is disposed corresponding to the cover fastening assembly 150, and the contact portion 119 is used to push the cover fastening assembly 150.

When the tension arm 115 is pressed, the contact portion 119 of the tension arm 115 and the positioning rod 144 simultaneously move toward the base 130, so the sanding belt 118 comes loose to allow an operator to replace the sanding belt 118 or perform maintenance work on other components in the body 120. After component maintenance or sanding belt replacement, the spring 142 pushes the positioning rod 144 and the tension arm 115 by its elasticity to thereby cause the sanding belt 118 to become tight again.

According to the first embodiment, the cover fastening assembly 150 preferably includes a release 151 and a resilient element 157 for restoring the release 151 to its original position. One end of the cover 170 is pivotally connected at one side of the body 120, and the other end of the cover 170 includes a fastening portion 172 engaged with the release 151. As shown in FIGS. 3 and 4, the embodiment includes a spring pin 174 pivotally connected to the cover 170 and the body 120. The spring pin 174 preferably has a slit (not labelled) and is used to prevent the cover 170 to be detached or fall off from the body 120.

The cover fastening assembly 150 further includes a fastening ring 154 mounted on a bottom end of the release 151, a push portion 155 and a hook 156 at one side of the push portion 155 are disposed at a top end of the release 151. The release 151 preferably has a T shape and consists of a head portion 152 and a rod portion 153. The push portion 155 and the hook 156 are disposed in the head portion 152. The fastening ring 154 is fastened to an annular groove 159 of the rod portion 153. The contact portion 119 of the tension arm 115 is disposed corresponding to the release 151, and the push portion 155 of the release 151 is moved when pushed by the contact portion 119.

The base 130 includes a through hole 131, and the release 151 is received in the resilient element 151 and inserted in the through hole 131. The resilient element 157 is, for example, a compression spring. The resilient element 157 and the fastening ring 154 resiliently limits the release 151 to stay in the through hole 131. The through hole 131 forms a first diameter 132 for receiving the resilient element 157 and a second diameter 133 for receiving the head portion 152. The second diameter 133 is larger than the first diameter 132, and the head portion 152 is blocked by the portion of the through hole 131 having the first diameter 132.

When the tension arm 115 is pressed, the contact portion 119 of the tension arm 115 pushes the push portion 155 to move a distance D in a direction horizontal to the tension arm 115. The hook 156 moves in a direction horizontal to the tension arm 115 to be released from the fastening portion 172, so that the cover 170 is opened by rotating about the spring pin 174, as shown in FIG. 4. When the tension arm 115 is not pressed, the positioning rod 144 and the tension arm 155 are pushed by the spring 142 by its elasticity. At the same time, the resilient element 157 also pushes by its elasticity the head portion 152 to restore the release 151 to its original position. Restricted by the fastening ring 154, the release 151 is in contact with a bottom of the base 130, as shown in FIG. 3.

Please refer to FIGS. 5 to 8 for drawings in connection with the second embodiment of the present invention. The second embodiment is different from the first embodiment in the cover fastening assembly 150. The remaining structure details are the same to the first embodiment, so a description thereof is omitted herein for brevity.

The cover fastening assembly 150 includes a pivot shaft 158 pivotally connected the release 151, and the base 130 includes a recess 134 accommodating the release 151 and the resilient element 157. The base 130 is preferably disposed on the body 120, instead of being a foundation of the extendable support rod 140. The recess 134 includes a positioning recess 135 for positioning the resilient element 157. One end of the resilient element 157 is preferably in contact with the push portion 155 at one side thereof. The pivot shaft 158 is, for example, a pin inserted in the base 130 of the body 120.

Figure 6:
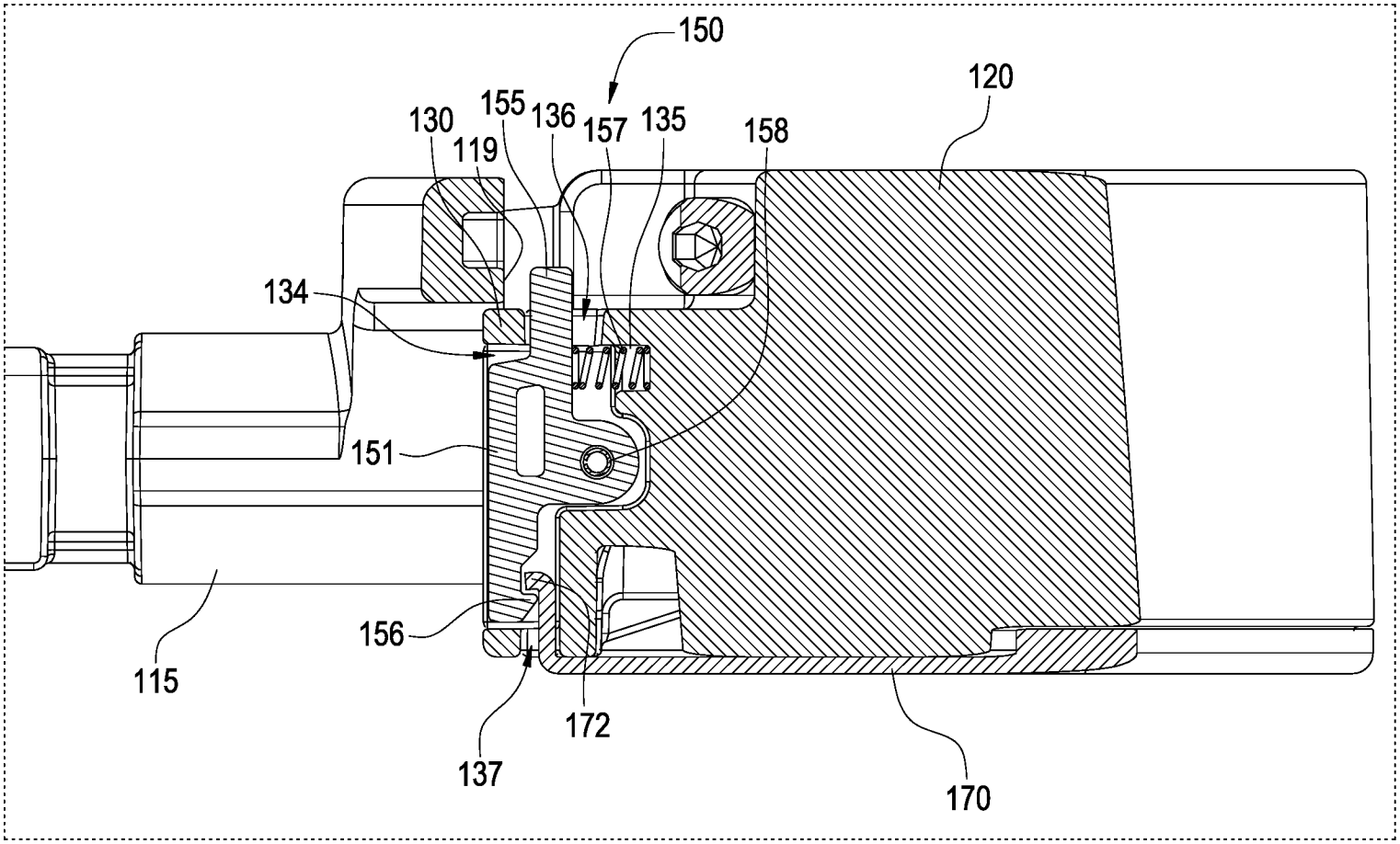
FIG. 6 is a partial cross-sectional view according to the second embodiment of the present invention.
Figure 7:
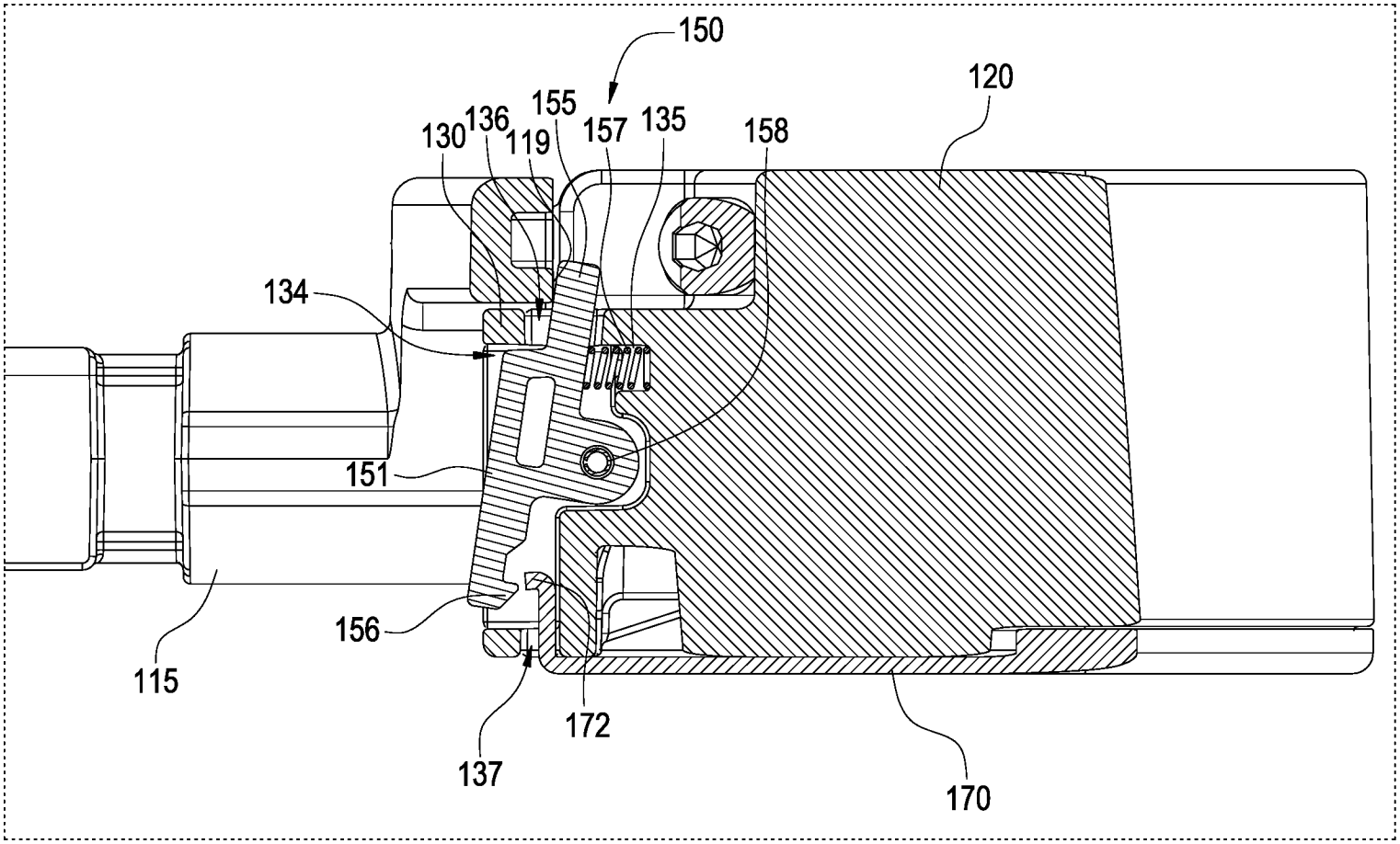
FIG. 7 is another partial cross-sectional view according to the second embodiment of the present invention.

Referring to FIGS. 6 and 7, the base 130 further includes two openings 136, 137 opposite to each other and communicating with the recess 134, a hook 156 and a push portion 155 protruding out of the opening 136 are disposed at two ends of the release 151 respectively, and the fastening portion 172 of the cover 170 is inserted into the opening 137 to be engaged with the hook 156 to fasten and lock the cover 170.

Figure 8:
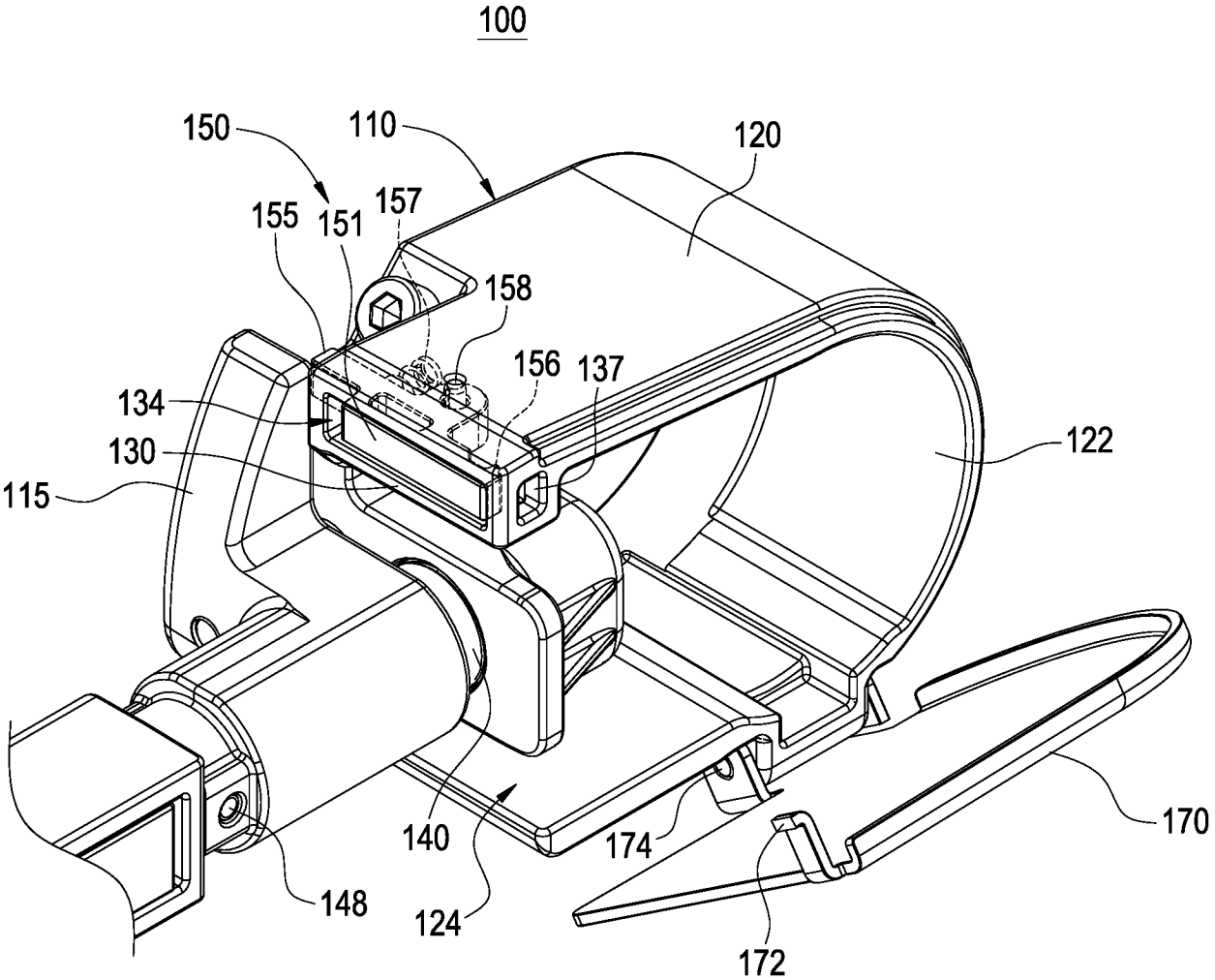
FIG. 8 is another perspective view according to the second embodiment of the present invention.
Figure 9:
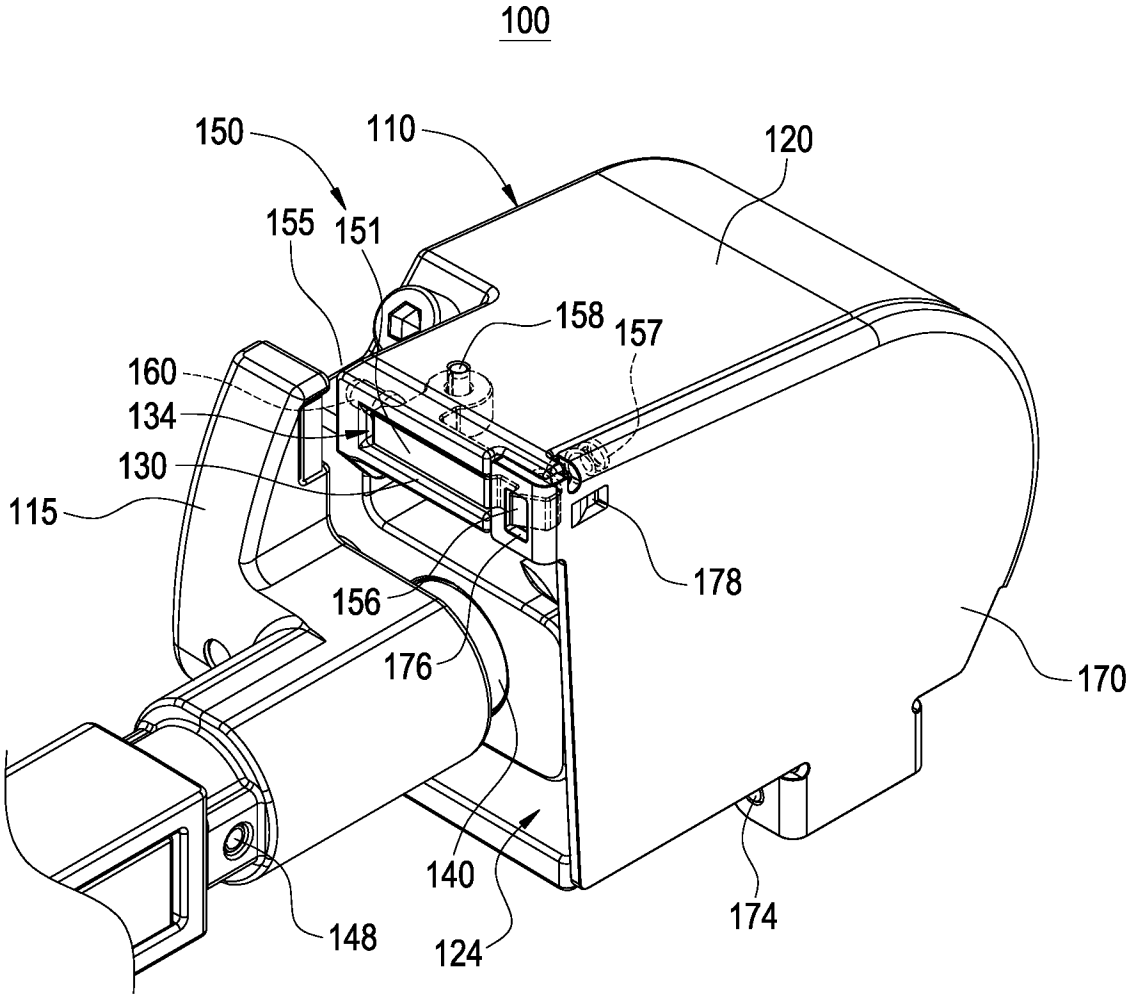
FIG. 9 is a partial perspective view according to the third embodiment of the present invention.

The pivot shaft 158 is preferably disposed between the hook 156 and the push portion 155. The release 151 is rotated about the pivot shaft 158 by means of lever principle. When the tension arm 115 is pressed, the contact portion 119 of the tension arm 115 pushes the push portion 155 in a direction parallel to the tension arm 115, so that the release 151 is rotated about the pivot shaft 158, and thereby the hook 156 is released from the fastening portion 172. Therefore, the cover 170 rotates about the spring pin 174 and rapidly bounces open, as shown in FIG. 8. When the tension arm 115 is not pressed, the spring 142 pushes by its elasticity the positioning rod 144 and the tension arm 115 to restore them to their original positions. At the same time, the resilient element 157 also pushes the push portion 155 to restore the release 151 to its original position, as shown in FIG. 6.

It should be noted that, when the fastening portion 172 of the cover 170 is rotated to be inserted into the recess 134 via the opening 137, one end of the hook 156 has an inclined surface (not labelled) disposed corresponding to the fastening portion 172. Therefore, the fastening portion 172 can smoothly and rapidly pass the inclined surface and engage the hook 156 by means of the resilient element 157 of the release 151. Furthermore, the fastening portion 172 and the hook 156 are engaged in the recess 134 of the body 120. In other words, the cover fastening assembly 150 is disposed inside the body 120, thereby preventing the cover 170 from being opened accidently due to inadvertent touches by the operator.

Please refer to FIGS. 9 to 12 for drawings in connection with the third embodiment of the present invention. The third embodiment is different from the first embodiment in the cover fastening assembly 150. The remaining structure details are the same to the first embodiment, so a detail description is omitted herein for brevity. The cover fastening assembly 150 of the third embodiment includes a pivot shaft 158 pivotally connected to the release 151 and includes a push pin 160 used to push the release 151. The base 130 includes a recess 134 accommodating the release 151 and the resilient element 157. The base 130 also includes a pin hole 138 for accommodating the pin hole 138. The base 130 is disposed on an inner surface of the body 120 at one side.

The fastening portion 172 is preferably a fastening hole 176, the cover 170 includes a resilient plate 178 at one side of the fastening hole 176, and a hook 156 engaged with the fastening hole 176 and a push portion 155 pushed by the push pin 160 are disposed at two ends of the release 151, respectively. The recess 134 has a positioning recess 135 for positioning the resilient element 157. One end of the resilient element 157 is in contact with the hook 156 at one side thereof.

Figure 10:
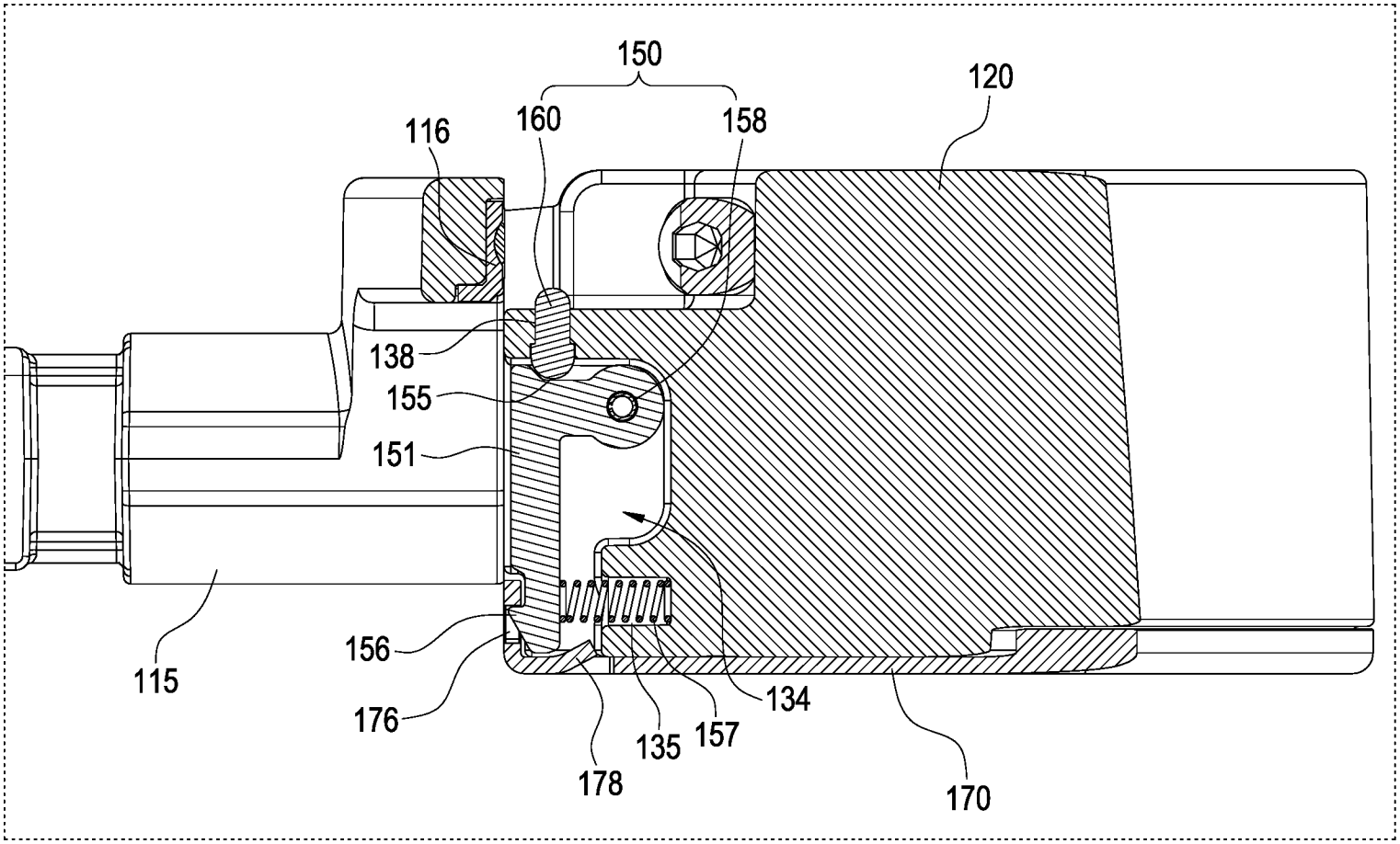
FIG. 10 is a partial cross-sectional view according to the third embodiment of the present invention.
Figure 11:
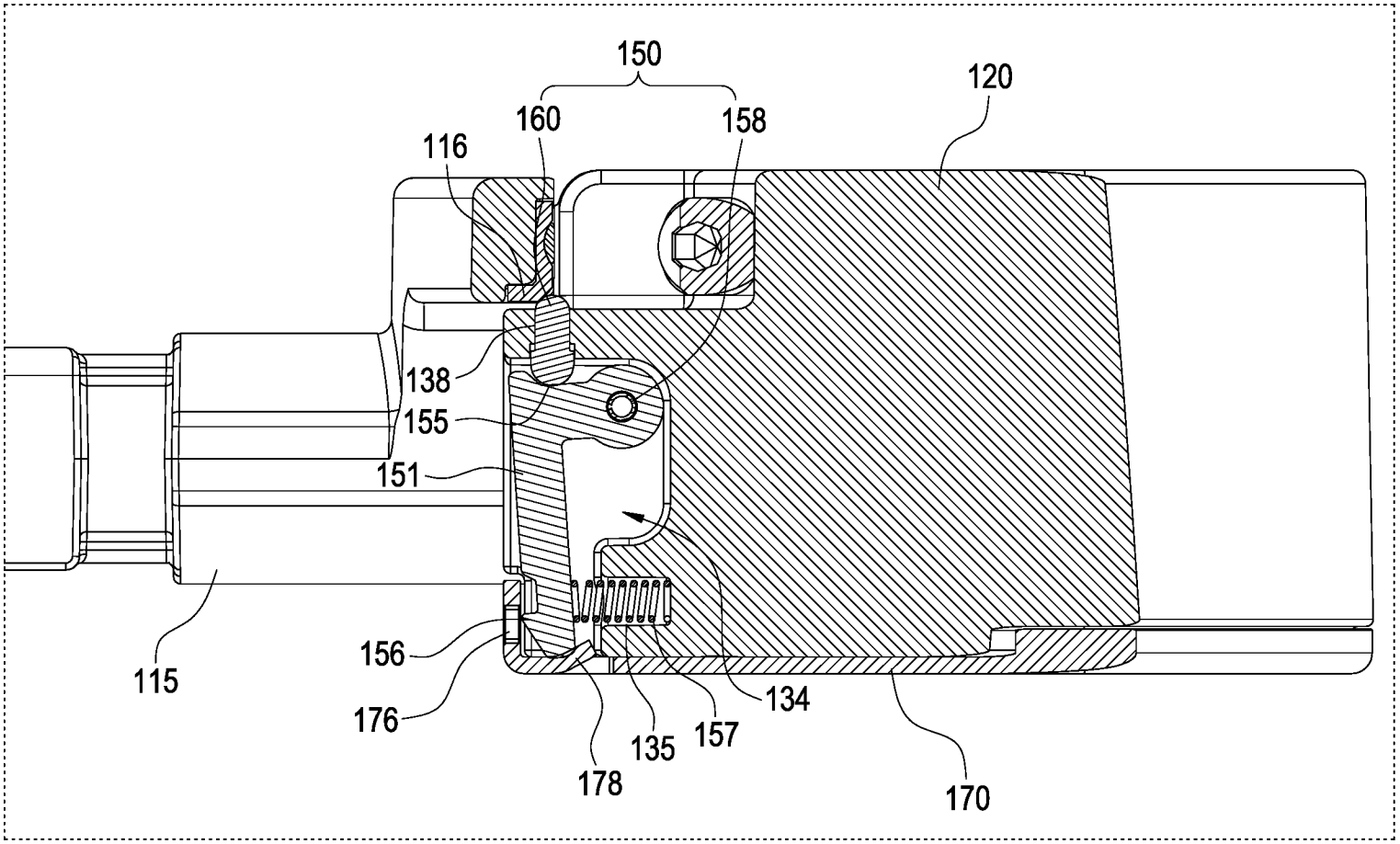
FIG. 11 is another partial cross-sectional view according to the third embodiment of the present invention.

In the embodiment shown in FIGS. 10 and 11, the release 151 preferably has an L shape, and the pivot shaft 158 and the hook 156 are at two ends of the L shape. The push portion 155 is preferably located at a short side of the L-shaped release 151 and is disposed near the pivot shaft 158. The hook 156 is located at a long side of the L-shaped release 151. A contact plate 116 is disposed at one end of the tension arm 115 and is arranged corresponding to the push pin 160. The contact plate 116 is used to push the push pin 160 toward the recess 134. In the present embodiment, the contact portion 119 is preferably replaced by the contact plate 116. The contact plate 116 and the push pin 160 are preferably made of metal or alloy thereof to withstand wearing and prolong a lifespan.

Figure 12:
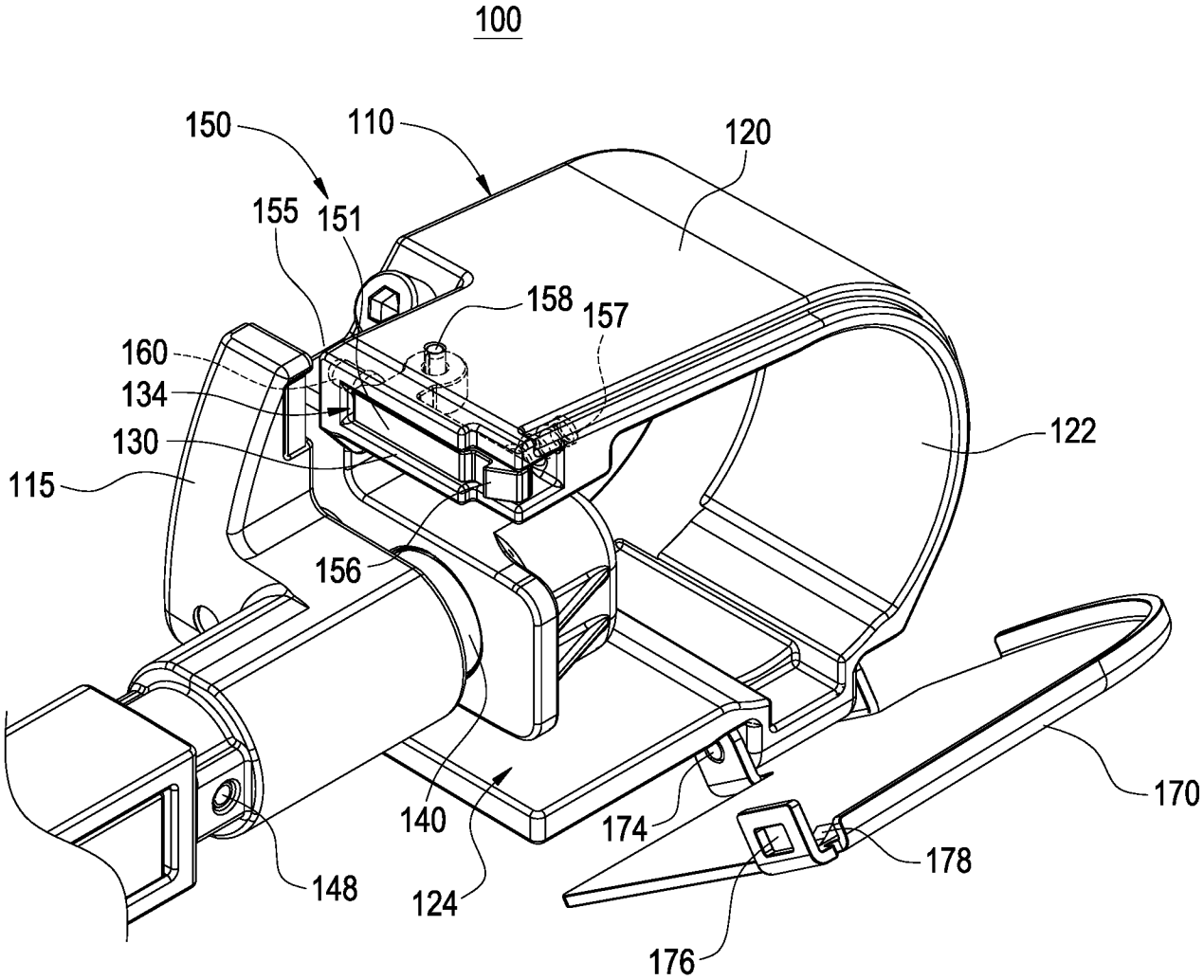
FIG. 12 is another perspective view according to the third embodiment of the present invention.

When the tension arm 115 is pressed, the contact plate 116 of the tension arm 115 is moved to push the push pin 160, so that the push pin 160 pushes the push portion 155, and the release 151 is rotated about the pivot shaft 158. At the same time, the hook 156 is rotated toward the resilient element 157 to be released from the fastening hole 176 and is then rotated to contact the resilient plate 178, so that the cover 170 bounces open using the spring pin 174 as a rotation axis, as shown in FIG. 12. Similarly, when the tension arm 115 is not pressed, the spring 142 pushes and restores the positioning rod 144 and the tension arm 115 to their original positions. At the same time, the resilient element 157 also pushes the hook 156 to restore the release 151 to its original position, so that the release 151 is again engaged with the fastening hole 176, as shown in FIG. 10.

By pressing the tension arm 115 of the belt sander 100, the cover 170 can be opened fast and automatically. No hand tools are required during the process of opening the cover 170. Opening operation is easy and does not cause the cover 170 to be detached or fall off from the body 120. Furthermore, the cover fastening assembly 150 is disposed inside the body 120, and the fastening portion 172 of the cover 170 is engaged inside the body 120 with the cover fastening assembly 150, so the operator is prevented from inadvertently touching the cover 170 to open it, thereby preventing danger. In other words, the belt sander 100 greatly improves safety in use.

According to one embodiment of the present invention, when the cover 170 is unlocked, the cover 170 automatically bounces open. As a result, maintenance or replacement of the components is easy and time efficient. When the cover 170 and the cover fastening assembly 150 is back to a locked state, the fastening portion 172 is resiliently engaged with the hook 156 again, so opening or closing operation is easy and simple.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A belt sander having a releasable cover structure, comprising:

a drive mechanism, the drive mechanism including a drive module, a tension arm, a driven wheel, and a sanding belt, wherein the tension arm is disposed between the driven wheel and the drive module, and the sanding belt surrounds the driven wheel, the drive module, and the tension arm;

a body receiving the drive module, the body including a base, an extendable support rod, and a cover fastening assembly, wherein the extendable support rod is extended from the body and connected to the tension arm, and the cover fastening assembly is disposed within and partially extended from the base, and the tension arm includes a contact portion configured to contact the cover fastening assembly, and the cover fastening assembly includes a release arm and a resilient element, the release arm is engageable with the contact portion of the tension arm and the resilient element is configured to restore the release arm to an original position, the release arm includes a push portion and a hook disposed on a top end thereof, and the hook is located on one side of the push portion; and a releasable cover, one end of the cover being pivotally connected at one side of the body, the other end of the cover including a fastening portion engaged with the hook of the release arm, wherein when the releasable cover is in a closed position and the tension arm is pressed, the contact portion of the tension arm is configured to push the push portion and the hook to move, and the fastening portion is disengaged from the hook.

2. The belt sander having the releasable cover structure according to claim 1, wherein the base includes a through hole, the release arm is received in the resilient element, and both of the release arm and the resilient element are inserted in the through hole, the release arm includes a head portion and a rod portion connected to the head portion, the push portion and the hook are disposed in the head portion, and the resilient element biases the release arm to stay in the through hole.

3. The belt sander having the releasable cover structure according to claim 1, wherein the cover fastening assembly includes a pivot shaft pivotally connecting the release arm, and the base includes a recess accommodating the release arm and the resilient element.

4. The belt sander having the releasable cover structure according to claim 3, wherein the base further includes two openings communicating with the recess, the hook and the push portion which protrudes out one of the openings are disposed at two ends of the release arm respectively, and the fastening portion is inserted into the other one of the openings to be engaged with the hook.

5. The belt sander having the releasable cover structure according to claim 4, wherein the pivot shaft is disposed between the hook and the push portion, the contact portion of the tension arm pushes the push portion to rotate the release arm about the pivot shaft, and thereby the hook is released from the fastening portion.

6. The belt sander having the releasable cover structure according to claim 1, wherein the cover fastening assembly includes a pivot shaft pivotally connected to the release arm and a push pin which is used to push the release arm, the release arm is rotatable about the pivot shaft, and the base includes a recess accommodating the release arm and the resilient element and includes a pin hole for accommodating the push pin.

7. The belt sander having the releasable cover structure according to claim 6, wherein the fastening portion is a fastening hole, the cover includes a resilient plate at one side of the fastening hole, and the hook is engaged with the fastening hole and the push portion being pushed by the push pin are disposed at two ends of the release arm, respectively.

8. The belt sander having the releasable cover structure according to claim 7, wherein the release arm is formed in a straight line, and one end of the tension arm is moved to push the push pin, so that the push pin pushes the push portion, the hook is released from the fastening hole and rotated to contact the resilient plate.

* * * * *